US005467842A

United States Patent [19]

Meloy

[11] Patent Number: 5,467,842

[45] Date of Patent: Nov. 21, 1995

[54] COLLAPSIBLE SAW HORSE

[76] Inventor: John Meloy, 820 N. Creek, Dewey, Okla. 74029

[21] Appl. No.: 366,257

[22] Filed: Dec. 29, 1994

[51] Int. Cl.[6] ..... B27B 27/00

[52] U.S. Cl. ..... 182/153; 182/151

[58] Field of Search ..... 182/153, 181–186, 182/225, 151

[56] References Cited

U.S. PATENT DOCUMENTS

| | | | |
|---|---|---|---|
| D. 192,700 | 5/1962 | O'Connor | 182/181 X |
| 812,344 | 2/1906 | Howser | 182/153 |
| 1,224,893 | 5/1917 | Beckwith . | |
| 3,148,746 | 9/1964 | Joculano . | |
| 4,152,834 | 5/1979 | Stansberry . | |
| 4,489,808 | 12/1984 | Voye . | |
| 4,502,563 | 3/1985 | Pershon . | |
| 4,620,613 | 11/1986 | Albertson . | |
| 4,730,698 | 3/1988 | Harris . | |
| 4,771,863 | 9/1988 | Stansberry . | |
| 4,880,080 | 11/1989 | Brockman . | |
| 4,903,796 | 2/1990 | Magyar | 182/185 X |
| 4,951,782 | 8/1990 | Hanson . | |

FOREIGN PATENT DOCUMENTS

| | | | |
|---|---|---|---|
| 841348 | 6/1952 | Germany | 182/153 |

*Primary Examiner*—Alvin C. Chin-Shue
*Attorney, Agent, or Firm*—Head & Johnson

[57] ABSTRACT

There is disclosed an improved collapsible saw horse comprising a horizontal member over the center of which is affixed a tubular spacer. Left and right rotatable sleeves are disposed over the horizontal member on each side of the tubular spacer to obtain an assembled crossbar. Four legs, each connected to a collar complementary to the horizontal member, serve to support the horizontal member. The legs are further defined as a left outer leg, left inner leg, right inner leg, and right outer leg. The collars are of a shape similar to the rotatable sleeves and the tubular spacer such that when disposed over the horizontal member a smooth profile is obtained. Four angled braces are arranged as follows: (1) a first brace from the left outer leg to the left rotatable sleeve; (2) a second brace from the left inner leg to the tubular spacer; (3) a third brace from the right inner leg to the tubular spacer; and (4) a fourth brace from the right outer leg to the right rotatable sleeve. A cover is provided for the crossbar to further smooth its surface, and chains are affixed between each pair of legs so that a maximum pivoting angle between the legs is established.

9 Claims, 2 Drawing Sheets

COLLAPSIBLE SAW HORSE

BACKGROUND OF THE INVENTION

1. Field of the Invention

The present invention relates to a collapsible saw horse, and, more specifically, to an exceptionally sturdy yet light weight collapsible saw horse which is provided with legs that pivot toward one another so that the saw horse requires less storage space and may be more easily handled.

2. Background

The uses for saw horses are well known. Saw horses are generally bulky and require a fair amount of storage space. Attempts have been made to design a collapsible but sturdy saw horse which is capable of the same duties as a traditional saw horse yet requires a minimum of storage space. The problem with the majority of these prior art collapsible saw horses is that they are complex and difficult to fold and unfold.

One patent which attempted to avoid design complexity and difficulties in folding and unfolding is the collapsible saw horse of U.S. Pat. No. 4,502,563 to Pershon (1985). The Pershon collapsible horse utilizes two telescopically engaged tubular members, the inner member having a length which exceeds the length of the outer tubular member. A first pair of downwardly extending legs is attached to the longer member while a second pair of downwardly extending legs is attached to the shorter member. The Pershon invention allows the legs to easily collapse toward one another simply by lifting the saw horse off of the ground. A problem with the Pershon collapsible horse is that its design requires large tubular members in order to prevent flexing at the points of leg attachment. The requirement for large tubular members is primarily due to the fact that braces cannot be attached from the outer legs to the outer tubular member since the legs are rotatable with respect thereto. Another disadvantage is that the large pipe required results in the collapsible saw horse being unnecessarily heavy.

U.S. Pat. No. 3,148,746 to Joculano (1964) is another patent for a collapsible saw horse. The Joculano "foldable horse" possesses an interior rod with downwardly extending legs pivotally attached thereto. The attachments for the pivoting legs clamp around and extend above the horizontal crossbar. Therefore, the upper surface of the crossbar is not uniform and does not provide a smooth upper work surface. The Joculano patent additionally possesses cross braces which extend horizontally from the legs at one end to the legs on the other end. A more stable configuration is attainable by attaching the braces to the crossbar; however, this is not possible because the legs are rotatable with respect thereto. Furthermore, Joculano's horizontal braces do not permit the user to work in close proximity to the crossbar. The horizontal braces additionally provide a surface on which the user may strike or scrap his/her shins.

U.S. Pat. No. 812,344 to Howser (1906) also teaches an adjustable type saw horse structure. The Howser patent shows diagonal braces which are attached to the horizontal member. However, due to the extendable telescoping nature of the horizontal member, the upper surface is irregular. The diagonal brace attachments clamp around and extend above the horizontal member, and the manner in which the legs are affixed to the horizontal member also render the upper surface of the horizontal member irregular. Therefore, the Howser patent does not provide a smooth surface for a workstation. The device also requires the user to manipulate the clamping mechanisms.

SUMMARY OF THE INVENTION

It is therefore an object of the present invention to provide a collapsible saw horse which overcomes the aforementioned limitations of the prior art. One advantage of the Applicant's invention is that it is light weight, sturdy and easily collapsible and expandable.

A further object of the present invention is to provide an improved collapsible saw horse possessing strength enhancing diagonal braces, yet still capable of being collapsed and expanded with ease.

Another object of the present invention is to provide an improved collapsible saw horse that is constructed so as to eliminate flex at the location of the leg tie-ins.

A still further object of Applicant's invention is to provide an improved collapsible saw horse that permits the user to gain close access to the crossbar of the device without the danger and nuisance of being obstructed by horizontal braces.

An additional object of the present invention is to provide a collapsible support device constructed in a manner such that pipe of a smaller diameter and lighter gauge may be utilized. This results in a lighter and more easily manageable saw horse.

Another object of the present invention is to provide an improved collapsible saw horse constructed to allow for the use of diagonal braces and pivoting downwardly extending legs, while having a smooth crossbar profile, therefore providing a smooth and uniform working surface.

These and other objects and advantages are provided by Applicant's improved collapsible saw horse. Generally speaking, Applicant's invention includes a saw horse type support having a crossbar. The crossbar is made up of rotatable sleeves disposed over an inner horizontal member. A plurality of legs are mounted on the crossbar by means of collars. The collars are of similar shape to the rotatable sleeves such that, when the apparatus is assembled, the crossbar is of a uniform diameter. Angled braces are attached to the legs and extend from the legs to the rotatable sleeves. The braces serve to add strength to the device. They also work to restrict axial displacement of the legs and rotatable sleeves from the horizontal member. The rotatable sleeves attached to the angled braces are free to rotate in sequence with the legs, thereby allowing the leg and the brace to be swiveled with respect to the horizontal member. This unique design allows for a collapsible saw horse which is unusually sturdy due to the angled braces which extend from the rotatable sleeves to the legs.

In its most preferred embodiment, Applicant's invention comprises a horizontal member over the center of which is affixed a tubular spacer. Left and right rotatable sleeves are disposed over the horizontal member on each side of the tubular spacer to obtain an assembled crossbar. Four legs, each connected to a collar complementary to the horizontal member, serve to support the horizontal member. The legs are further defined as a left outer leg, left inner leg, right inner leg, and right outer leg. The collars are of a shape similar to the rotatable sleeves and the tubular spacer such that when disposed over the horizontal member a smooth profile is obtained. Four angled braces are arranged as follows: (1) a first brace from the left outer leg to the left rotatable sleeve; (2) a second brace from the left inner leg to the tubular spacer; (3) a third brace from the right inner leg to the tubular spacer; and (4) a fourth brace from the right outer leg to the right rotatable sleeve. A cover is provided for the crossbar to further smooth its surface, and chains are affixed between each pair of legs so that a maximum pivoting angle between the legs is established.

The novel design of Applicant's improved collapsible saw horse leads to many advantages. For one, Applicant's device does not require difficult welds or clamping to the horizontal member. Rather, the pieces, or components, of Applicant's invention are held in place by a novel bracing arrangement. Other than a pin assembly inserted through the tubular spacer and horizontal member, the spatial relationships of the component parts of Applicant's invention are maintained by what can be termed interlocking, angled bracing. The angled bracing also provides strength not previously attained by prior art devices because of the obstacles heretofore encountered in incorporating angled bracing with a collapsible structure. The diagonal bracing also eliminates flex at the point of tie-in between the legs and the crossbar. The added strength of angled bracing allows the device to be constructed of a smaller diameter, or lighter gauge, of pipe than previously possible. Of course, this translates into a lighter weight, more easily manageable, apparatus. Further, the angled braces permit the user to gain close access to the device without the danger and nuisance of being obstructed by horizontal braces. Yet despite its interlocking, angled bracing, Applicant's invention is easily collapsible. All legs collapse toward the vertical center of the device. Since no clamps or other holding means are necessary, the crossbar of Applicant's device may be made to have a smooth profile. This, especially coupled with a crossbar cover, eliminates damage to work items and makes safer the use of the device, as less catching or binding will be encountered such as when feeding board through high speed saws.

A better understanding of the invention, and the objects and advantages thereof, will be obtained from the following description, taken in conjunction with the claims and attached drawings.

DETAILED DESCRIPTION OF THE PREFERRED EMBODIMENTS

Applicant's collapsible horse 10 is generally constructed of a plurality of rotatable sleeves 13, 14, and rotatable collars 15–18, disposed over an inner horizontal member 11 to form a crossbar. A plurality of legs 19–22 each connect to a collar 15–18 and are mounted over the horizontal member 11. A plurality of angled braces 23*a–d* are affixed to legs 19–22, and span between the legs and the rotatable sleeves in a novel fashion. A cover 26 is provided to be affixed over the crossbar.

Figure 1:
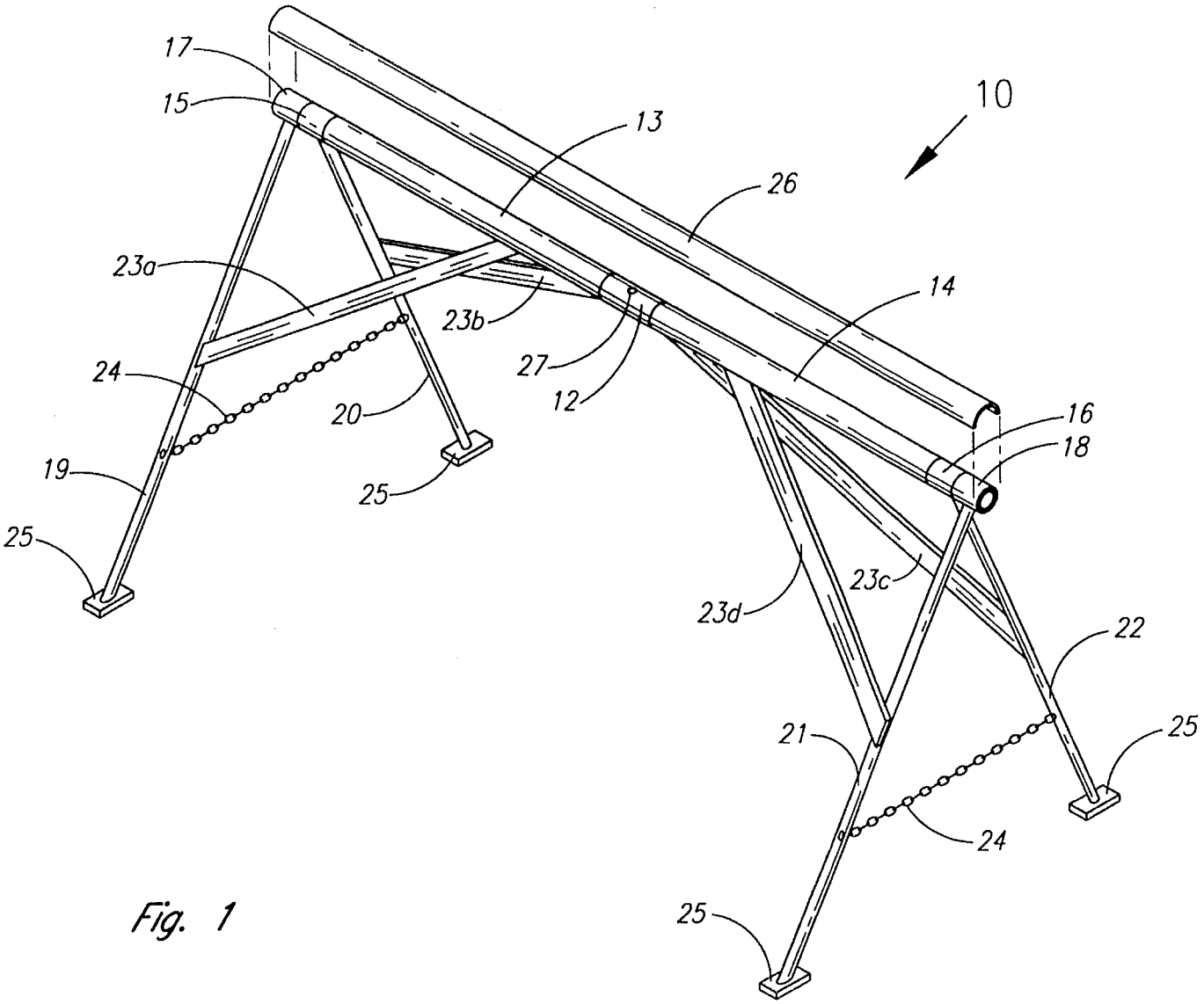
FIG. 1 is a perspective view of the preferred embodiment of the invention shown with a detachable cover.

More specifically, and referring initially to FIG. 1, there is shown a perspective view of Applicant's improved collapsible saw horse. The apparatus is designated generally by the reference numeral 10. The device comprises a horizontal member 11 (not shown). Disposed over the horizontal member 11, from left to right as seen in the drawing, are the left outer leg collar 17, the left inner leg collar 15, the left rotatable sleeve 13, the tubular spacer 12, the right rotatable sleeve 14, the right inner leg collar 16, and the fight outer leg collar 18.

Horizontal member 11 may be constructed of any suitable material, round pipe being preferred. The dimensions of horizontal member 11 may be varied, but the diameter of horizontal member 11 will always be less than that of rotatable sleeves 13, 14, tubular spacer 12, and collars 15–18. Rotatable sleeves 13, 14 are sized complementary to horizontal member 11. By "complementary to", it is meant that rotatable sleeves 13, 14 are positionable over horizontal member 11 in a manner such that they are rotatable with respect to horizontal member 11. Collars 15–18 are sized and shaped similarly to rotatable sleeves 13, 14. While tubular spacer 12 is sized and shaped similar to rotatable sleeves 13, 14 and collars 15–18, it is not rotatable with respect to horizontal member 11. Instead, tubular spacer 12 is affixed to horizontal member 11 by a pin assembly 27. Thus, tubular spacer 12 can be said to be rotatably affixed to horizontal member 11, as tubular spacer 12 is conjoined to horizontal member 11 and will thus rotate along with horizontal member 11 with respect to rotatable sleeves 13, 14 and collars 15–18. As is seen in the drawing, rotatable sleeves 13, 14, tubular spacer 12, and collars 15–18 are of a similar shape and size such that when all are disposed over horizontal member 11 a smooth profile is obtained.

Attached to the left outer leg collar 17 is the first, or outer, left leg 19. Attached to the left inner leg collar 15 is the second, or inner, left leg 20. Together, outer left leg 19 and inner left leg 20 comprise a first pair of legs. Connected to the right outer leg collar 18 is the outer right leg 21, and attached to the right inner leg collar 16 is the inner right leg 22. Outer right leg 21 in combination with inner right leg 22 comprise a second pair of legs. A chain 24 is shown connecting the left pair of legs 19, 20 and the fight pair of legs 21, 22. Chain 24 provides a means for restraining each pair of legs so that a maximum pivoting angle between each pair of legs is established. Shown attached at the end of each of the legs 19–22 opposite collars 15–18 is a base piece, or foot portion, 25.

Angled from legs 19–22 to either rotatable sleeves 13, 14 or tubular spacer 12 are braces 23*a–d*. A first brace 23*a* originates at approximately the midpoint of left outer leg 19 and terminates along left rotatable sleeve 13. A second brace 23*b* has its origin at about the midpoint of left inner leg 20 and is affixed to tubular spacer 12. From the midpoint of right inner leg 22 to tubular spacer 12 runs a third brace 23*c*. In a similar fashion, a fourth brace 23*d* is connected at one end to the middle of right outer leg 21 and at the other end to right rotatable sleeve 14. The braces 23*a–d* are preferably affixed at their respective origins and insertions by welding.

A removable cover 26 is shown detached from the invention. The removable cover is constructed in a snap-on/snap-off manner. It may be formed of a variety of substances, but PVC is preferred.

Figure 2:
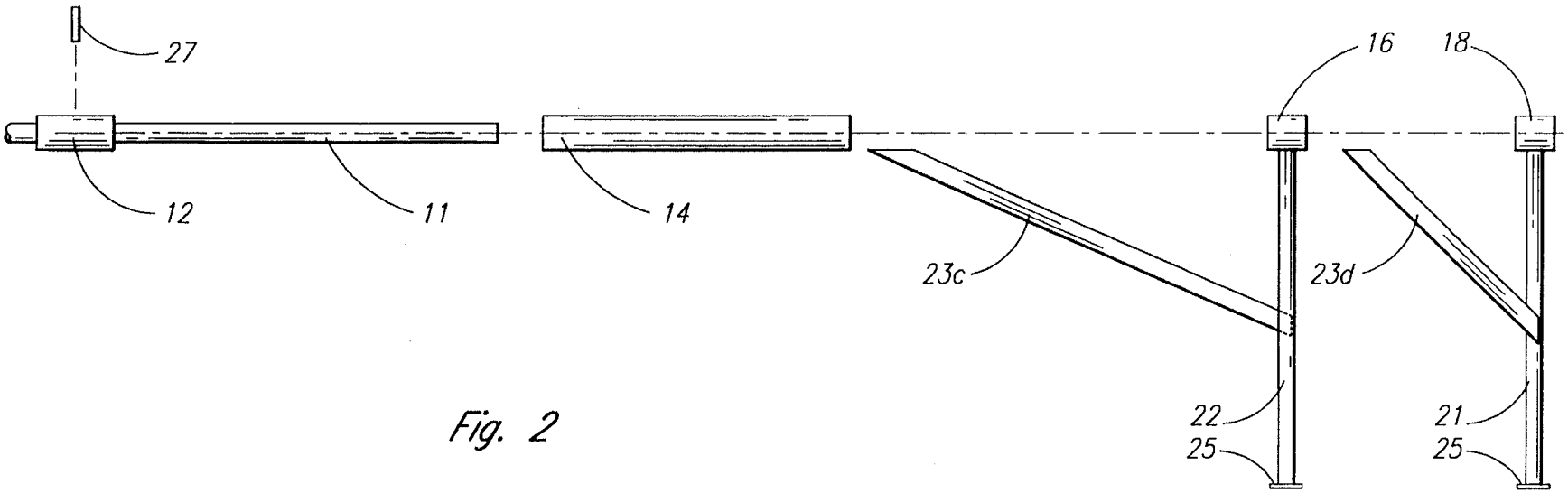
FIG. 2 is an exploded elevation view of the preferred embodiment of the invention.

FIG. 2 shows the horizontal member 11 over the center of which has been placed tubular spacer 12. Tubular spacer 12 is affixed to horizontal member 11 by pin assembly 27. Shown removed from, or slid off of, horizontal member 11 is right rotatable sleeve 14, right inner leg 22 and collar 16, as well as right outer leg 21 and collar 18. Brace 23*d* is affixed to the midpoint of right inner leg 22, while brace 23*c* is connected to the middle of right outer leg 21. Upon assembly, brace 23*c* will be attached to tubular spacer 12 and brace 23*d* will be attached to right rotatable sleeve 14. Attached to the ends of the legs 21, 22 opposite collars 16, 18 are base pieces 25.

Figure 4:
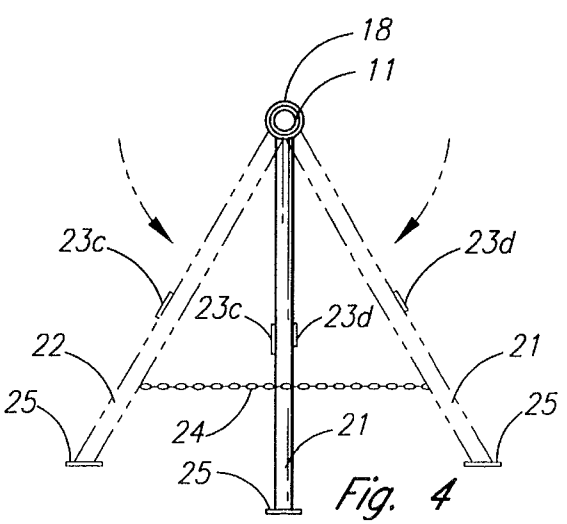
FIG. 4 is an end view depicting the invention shown in its collapsed and an expanded state.
Figure 3:
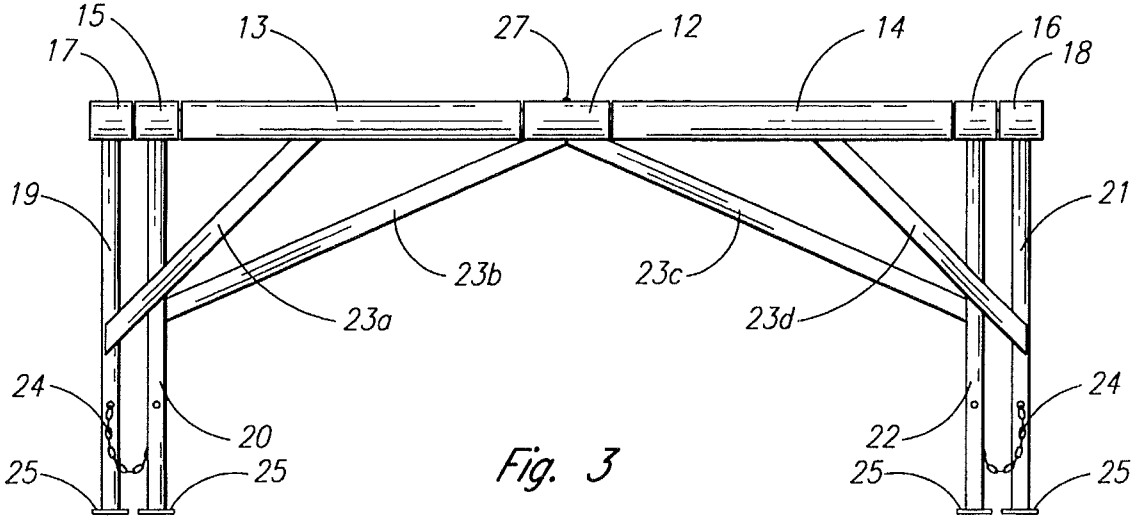
FIG. 3 is an elevation view of the collapsed invention.

FIG. 3 shows an elevational view of the preferred embodiment of Applicant's invention, while FIG. 4 is an end view of the same embodiment which depicts the invention in both a folded and expanded position. Visible in FIG. 4 is the horizontal member 11 which is disposed within the right outer leg collar 18. As is seen, when the invention is in its collapsed position, it is substantially planar.

The invention is preferably assembled by first placing tubular spacer 12 over the center of horizontal member 11, complementary pin receiving holes having been drilled in tubular spacer 12 and horizontal member 11. A pin 27 is inserted into the pin receiving holes to affix tubular member 12 to horizontal member 11. After collars 15–18 have been each welded onto their respective legs 19–22, they are positioned appropriately over horizontal member 11. Braces 23*a–d* are then welded to legs 19–22 and rotatable sleeves 13, 14 or tubular spacer 12 as indicated.

In operation, legs 19–22 are simply extended such that the device is maintained in a stable position. Since braces 23*b* and 23*c* have their insertion points on tubular spacer 12, outer legs 19, 21 may be extended, or swung out, from the vertical plane created by the collapsed invention without regard to the position of inner legs 20, 22 or rotatable sleeves 13, 14. Conversely, because braces 23*a* and 23*d* have their insertion points on rotatable sleeves 13 and 14, respectively, inner legs 20, 22 may be operated independently. The device may be collapsed for storage or transportation merely by lifting. Crossbar cover 26 may be snapped on or off as desired.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An improved collapsible saw horse, comprising:

a. a crossbar having a plurality of rotatable sleeves disposed over an inner, horizontal member;

b. a plurality of legs, each connected to a collar complementary to said horizontal member, said collars being of a shape similar to said rotatable sleeves such that when said sleeves and collars are disposed over said horizontal member a smooth profile is obtained; and c. a plurality of braces angled from said legs to said rotatable sleeves and rigidly affixed to said rotatable sleeves, such that said legs and said rotatable sleeves are maintained in spatial relationship without being affixed to said horizontal member and such that said legs are collapsible.

2. An improved collapsible saw horse according to claim 1, further comprising means for restraining said legs so that a maximum pivoting angle between said legs is established.

3. An improved collapsible saw horse according to claim 2, wherein said means for restraining said legs comprises a chain.

4. An improved collapsible saw horse according to claim 1, further comprising a cover for said crossbar.

5. An improved collapsible saw horse, comprising:

a. a horizontal member over the center of which is affixed a tubular spacer;

b, left and right rotatable sleeves disposed over said horizontal member on each side of said tubular spacer;

c. four legs, each connected to a collar complementary to said horizontal member, said collars being of a shape similar to said rotatable sleeves and said tubular spacer such that when disposed over said horizontal member a smooth profile is obtained, said legs being further defined as a left outer leg, left inner leg, right inner leg, and right outer leg; and d. four angled braces arranged as follows:

a first brace from said left outer leg to said left rotatable sleeve;

a second brace from said left inner leg to said tubular spacer;

a third brace from said right inner leg to said tubular spacer; and a fourth brace from said right outer leg to said right rotatable sleeve.

6. An improved collapsible saw horse according to claim 5, wherein said tubular spacer is affixed to said horizontal member by a pin assembly.

7. An improved collapsible saw horse according to claim 5, further comprising means for restraining said legs so that a maximum pivoting angle between said legs is established.

8. An improved collapsible saw horse according to claim 7, wherein said means for restraining said legs comprises a chain.

9. An improved collapsible saw horse according to claim 5, further comprising a cover for said crossbar.

* * * * *